US007297459B2

(12) United States Patent
Maric et al.

(10) Patent No.: US 7,297,459 B2
(45) Date of Patent: Nov. 20, 2007

(54) FLUIDIZED BED SPRAY COATING OF POLYESTER CHEMICAL TONERS WITH ADDITIVES

(75) Inventors: Milan Maric, Montreal (CA); Alan E. J. Toth, Burlington (CA); Marko D. Saban, Etobicoke (CA)

(73) Assignee: Xerox Corporation, Stamford, CT (US)

( * ) Notice: Subject to any disclaimer, the term of this patent is extended or adjusted under 35 U.S.C. 154(b) by 621 days.

(21) Appl. No.: 10/976,762

(22) Filed: Nov. 1, 2004

(65) Prior Publication Data

US 2006/0093956 A1 May 4, 2006

(51) Int. Cl.
*G03C 9/08* (2006.01)

(52) U.S. Cl. ..... 430/137.14; 430/137.1; 430/137.11

(58) Field of Classification Search ..... 430/137.1, 430/137.11, 137.14
See application file for complete search history.

(56) References Cited

U.S. PATENT DOCUMENTS 5,290,654 A 3/1994 Sacripante et al.
5,308,734 A 5/1994 Sacripante et al.
5,344,738 A 9/1994 Kmiecik-Lawrynowisz et al.
5,346,797 A 9/1994 Kmiecik-Lawrynowisz et al.
5,350,659 A 9/1994 Lee et al.
5,364,729 A 11/1994 Kmiecik-Lawrynowisz et al.
5,370,963 A 12/1994 Patel et al.
5,403,693 A 4/1995 Patel et al.
5,418,108 A 5/1995 Kmiecik-Lawrynowisz et al.
5,593,807 A 1/1997 Sacripante et al.
5,716,751 A 2/1998 Bertrand et al.
6,143,457 A 11/2000 Carlini et al.

*Primary Examiner*—Hoa Van Le
(74) *Attorney, Agent, or Firm*—Oliff & Berridge, PLC

(57) ABSTRACT

A process for manufacturing a toner having improved relative humidity sensitivity is described. The process comprises forming polyester toner particles by emulsion/aggratation, fluidizing the toner particles with a stream of inert gas while spraying the toner particles with a solution containing an additive affecting relative humidity sensitivity, and wherein the additive contacts a surface of the toner particles and the additive remains on the surface of the toner particles.

20 Claims, No Drawings

FLUIDIZED BED SPRAY COATING OF POLYESTER CHEMICAL TONERS WITH ADDITIVES

BACKGROUND OF THE INVENTION

1. Field of Invention

The present invention is directed to methods of applying an additive to the surface of a toner created by the emulsion/aggregation (EA) technique. In particular, the reduction of relative humidity (RH) sensitivity of the toner is accomplished by applying the additive to the surface of the toner during a fluidized bed spraying procedure.

2. Description of Related Art

EA polyester toner particles are very hydrophilic, and thus susceptible to poor or unpredictable triboelectric charging upon exposure to atmospheric humidity. More in particular, EA polyester toners have hydrophilic functional groups on the surface of the toner, causing humidity sensitivity. Such toner particles thus need to be treated with a hydrophobic agent in order to perform over a wide range in humidities.

Low humidity is frequently referred to as C-zone (approximately 20% relative humidity), and high humidity is frequently referred to as A-zone (approximately 80% relative humidity). In practical use, this is referring to the humidity of the environment during use of a printer. This difference leads to large RH sensitivity ratios, which means that the toner is effective in low humidity conditions but not in high humidity conditions. For reference purposes, the RH sensitivity ratio of untreated EA polyester toner particles can range from approximately 5 to 12. The ultimate goal is for the RH sensitivity ratio to be as close to one as possible. When such an RH sensitivity ratio is achieved, the toner is equally effective in both high humidity and low humidity conditions. Said another way, the toner has low sensitivity to changes in RH.

One method of improving RH sensitivity of EA polyester toner has included forming a hydrophobic shell around the toner particles. However, this method has not proven viable because fusing characteristics of the toner are too adversely affected.

Another method of improving RH sensitivity is to treat EA polyester toner particles with a hydrophobic agent in the wet chemistry stage to improve RH sensitivity as described in U.S. Pat. No. 6,143,457 to Carlini et al., which is incorporated herein by reference in its entirety. The wet chemistry method is a surface treatment method that occurs after toner particles have been grown to the desired size by the EA technique. During the wet chemistry method, surface additives are added to EA polyester toners prior to any removal of the liquid from toner mixture, i.e., additives are added to the toner slurry.

The wet chemistry method is very limiting. In practice, as the wet chemistry treatment proceeds, the more hydrophobic treated toner will precipitate from the solution before the treatment is complete, and will agglomerate. This presents a problem because once the toner particles agglomerate, it is very difficult to separate them, particularly if the temperature is high enough to cause particles to fuse together.

The EA polyester toner particles are hydrophilic because of sulfonate groups on their surface. As part of the wet chemistry method, a phosphonium bromide salt, such as stearyltributylphosphonium bromide (STBP), is added to mask the sulfonate groups. During this wet chemistry method, an ion exchange occurs, and the resulting toner has hydrophobic stearyl phosphonium groups deposited/bonded on its surface.

Once the polyester toners are coated with a hydrophobic surface additive, the water is removed from the toner slurry. The toner particles are usually approximately 10 to 15 percent of the total weight of the toner slurry. The first step in removing the water is a filtration step. The product collected in the filter is called a wet cake which consists of the toner and some residual water. The water in the wet cake is approximately 40 percent of the total weight of the wet cake. The wet cake is the product of any filtration method, not just the wet chemistry method.

Once the wet cake has been produced, it is still necessary to remove the remaining water to be able to effectively use the created toner particles. This is usually done by a fluidized bed or equivalent drying equipment.

Another problem of the wet-chemistry method is that the additive has to be soluble in water. This means that significant quantities of water are necessary to dissolve the additive. This requires additional reactor capacity, which is expensive. Furthermore, a relatively high temperature is necessary to keep the additive dissolved in solution. However, a high temperature may cause the toner particles to start to coalesce and deviate from the desired particle size and particle size distribution.

The problems of the wet chemistry method have resulted in a continued processing problems of the treated EA polyester toners. In particular, the wet chemistry additive application process of the prior art has resisted scale-up to date and is cumbersome and time consuming.

SUMMARY OF THE INVENTION

Therefore, a method to apply an additive to the surface of a toner particle to improve RH sensitivity that does not cause the toner particles to coalesce is necessary and one object of the present invention.

Thus, an embodiment of the present invention is a process that includes a hydrophobic chemical surface treatment applied to EA polyester toner particles during a fluidized bed drying process, rather than during the wet chemistry process, to improve charging performance, especially RH sensitivity, of the toner. This has reduced the RH sensitivity ratio, indicating that the toner becomes more effective in both high humidity and low humidity conditions. An additional benefit is that the toner particles do not coalesce during the process of applying an additive to the surface of a toner particle during the drying process since they are kept sufficiently far apart to prevent significant fusing of the particles.

Another benefit of the present invention is that compared to other approaches, the reactor throughput can be increased since the surface modification is now combined with the drying unit operation. Also, the additive does not need to be dissolved in a large amount of liquid and then added to a toner slurry. Instead, the solution containing the additive is sprayed onto the surface of the toner particles during the drying process. Any excess liquid of the solution is evaporated during the drying process.

DETAILED DESCRIPTION OF PREFERRED EMBODIMENTS

Polyester tends to be more hydrophilic compared to other resins used for toner formulations, particularly when the polyester contains polar sulfonated groups that are used in the EA process for growing polyester toner particles. To stabilize tribocharging of the toner during development, the hydrophilic polyester needs to be treated so that the surface becomes less sensitive to changes in the relative humidity (RH). This is usually done by adding a hydrophobic layer to the surface of the toner particles. The procedure that has been most used to accomplish this is a wet chemistry approach, as discussed above.

In the wet chemistry approach, as described herein, after the toner particles have been grown to the desired size, a solution of salt is added to the toner slurry and an exchange reaction takes place between the salt and the sulfonate groups on the resin prior to drying the toner particles.

The various embodiments of the present invention are an alternative to the wet chemistry method. In particular, embodiments of the invention pertain to a method of manufacturing a toner particle comprising forming polyester toner particles by emulsion/aggregation; fluidizing the toner particles with a stream of inert gas while spraying the toner particles with a solution containing an additive affecting relative humidity sensitivity; and wherein the additive contacts a surface of the toner particles and the additive remains on the surface of the toner particles. Embodiments of the present invention form a coating or shell around the toner particles formed by the EA technique.

The polyester toner particle of the present invention is known in the art, and comprises known composites such as polyester and colorants/pigments. Polyester toner particles created by the emulsion/aggregation process are illustrated in a number of patents, such U.S. Pat. No. 5,593,807, U.S. Pat. No. 5,290,654, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, and U.S. Pat. No. 5,364,729 each of which are incorporated herein by reference in their entirety. The polyester may comprise any of the polyester materials described in the aforementioned references. As these references fully describe polyester EA toners and methods of making the same, further discussion on these points is omitted herein.

After washing the polyester toner made by the EA technique, a filtration step may be conducted, and thereafter a wet cake is produced. This wet cake containing the untreated toner particles is placed in a device in which it may be fluidized. A most preferred device is a fluidized bed dryer. The procedure described herein can be used with any drying process that allows a liquid spray to be applied and allows sufficient contact time to allow good surface coverage with the coating solution. The wet cake is first fluidized, e.g., for approximately 1 minute to 2 hours, with a gas, prior to introducing the coating solution containing the RH sensitivity additive. Any gas may be used to effect fluidizing. Preferably, the gas is one that will not react with the toner particles, and thus inert gases are preferred. In a preferred embodiment, air is used as the fluidizing gas.

The fluidized bed dryer may have two separate nozzles or two separate sets of nozzles, one for introducing the gas for fluidizing and drying the wet cake, and another for introducing the additive solution. The nozzles can be arranged to spray the additive solution or the gas into the fluidized bed dryer at any suitable location, e.g., from above or below the toner particles. In a preferred embodiment, the nozzle(s) for introducing the additive solution into the dryer are located above a location of the toner particles in the dryer.

The RH sensitivity ratio is slightly better, compared to untreated toner particles, when the toner particles are sprayed with the additive solution from the bottom. However, when the toner particles are sprayed from the top, the C-zone charge drops while the A-zone charge is maintained. Thus, this results in lower RH sensitivity ratios compared to untreated toner particles. Spraying the additive solution from the top thus may more effectively incorporate the RH enhancing additive onto the toner to improved RH sensitivity.

The temperature in the fluidized bed sprayer is maintained at a temperature between 20° C. to 60° C., preferably 25° C. to 50° C. and more preferably 30° C. to 45° C. As the cake is being fluidized, the additive solution containing the surface additive is sprayed, e.g., misted, therein. Preferably, the solution is introduced at a constant rate of about 0.12 to 7.5 mL/min/kg wet cake, preferably 0.12 to 5 mL/min/kg wet cake, and more preferably 0.25 to 2.3 mL/min/kg wet cake. Varying the rate of introduction such that it is not constant may be done, as appropriate. In a preferred embodiment to coat about 2 kg of wet cake, the additive is sprayed until a total of 50 to 1000 mL of the solution containing the additive is sprayed onto the wet cake, preferably 50 to 700 mL, and more preferably 100 to 450 mL. Drying in the device may be continued after completion of the spraying step, e.g., for an additional 0.1 to 20 hours, preferably 0.5 to 10 hours, and more preferably 1 to 5 hours. Such drying assists in removing the solvent of the additive solution from the wet cake/toner particles.

Once the drying is completed, the moisture content of the wet cake may be about 1 to 7%, preferably 1 to 5%, and more preferably 1.4 to 2.2%. To further reduce the moisture content to below 1%, if desired, the wet cake can be dried for an additional 1 to 100 hours, preferably 50 to 90 hours, and more preferably 60 to 80 hours in a suitable final drying device such as an oven, for example, a vacuum oven.

The additive contacts and/or impacts the toner surface and remains on the toner surface to provide a hydrophobic surface coating upon the relatively hydrophilic toner resin particle. This additive layer acts to reduce the RH sensitivity of the EA polyester toner.

The additive solution may comprise an additive affecting relative humidity sensitivity in an amount of, e.g., 0.5 to 40% by weight of the solution, preferably 0.5 to 20% by weight, more preferably I to 10% by weight. The solvent for the additive solution may be any suitable organic solvent, preferably that does not adversely affect the toner particles, most preferably water so as to avoid explosion of the organic solvent.

As the RH sensitivity additive, stearyltributylphosphonium bromide (STBP) is preferable. Other salts, such as organic salts and tetra-alkylated ammonium or phosphonium salts, may also be used as the RH sensitivity additive. Colloidal fluoropolymers may also be used as the additive herein.

Examples of tetra-alkylated ammonium or phosphonium salts include benzyldimethylstearylammonium chloride, dimethyldistearyl ammonium bromide, stearyltributylphosphonium bromide, tetraphenylphosphonium bromide, and tetrabutylphosphonium bromide, dimethyldioctyldecylammonium chloride, hexadecyltributylphosphonium bromide, benzyltriphenylphosphonium chloride, butyltriphenylphosphium chloride, triphenylethylphosphonium bromide, the halide (fluoride, chloride, bromide, or iodide), acetate, phosphate, sulfate, or alkylsulfonate salts of tetra-alkylated ammonium or tetra-alkylated phosphonium compounds with C1 to C20 alkyl substituents, such as methyl, ethyl, propyl, n-butyl, sec-butyl, tert-butyl, n-pentyl, iso-pentyl, neo-pentyl, hexyl, heptyl, octyl, nonyl, decyl, undecyl, dodecyl, lauryl, tridecyl, tetradecyl myristyl, pentadecyl, hexadecyl, cetyl, heptadecyl, octadecyl, stearyl, nonadecyl, eicosyl, or mixtures thereof; and the aryl groups such as phenyl, benzyl, 2-phenylethyl, naphthyl, anthracenyl, phenanthrenyl and the like. This list is not exhaustive. Any surface additive capable of improving the RH sensitivity of the toner may be used in place of the STBP as used as an example herein.

The invention will now be further illustrated by way of the following examples. These Examples are only illustrative and are not intended to limit the scope of the present invention.

Two EA polyester toners were examined. One toner contained highlight color blue (HCB) pigment and the other toner contained cyan (C) pigment. Both of the pigment dispersions were obtained from Sun Chemical (Flexiverse).

EXAMPLE 1

For HCB particles (Sample 1), 230 g of wet cake (moisture content=38.65%) was fluidized at about 30° C. with air pressure at 40-50 psi for 1.5 hours. 1% aqueous STBP solution was then pumped in using a peristaltic pump at 0.8 mL/min until a total of 125 mL of solution was added. Drying was continued for an additional 4 hours. The moisture content of the dried toner was 1.4%.

Based on measuring the phosphorus content in the toner, only 29% of the theoretical phosphorus was incorporated into Sample 1+STBP. This was because the spray pattern of the solution was not optimized to mix the solution with the fluidized toner in a uniform manner. However, despite the low incorporation of STBP, the RH sensitivity of the toner was reduced nearly three times for Sample 1 (See Table 1 below).

EXAMPLE 2

For cyan particles (Sample 2), about 1 kilogram of wet cake (moisture content=37.96%) was charged to a 2 gallon lab-scale fluidized bed sprayer (Aeromatic, AG) and a stream of air at 40-50 psi pressure and 30° C. was used to fluidize the toner particles. After about 0.5 hour, a 1% aqueous STBP solution was pumped from a syringe pump through a nozzle entering the bed at a flow rate of about 3 mL/min. A total of 436 mL of solution was pumped into the dryer. Drying was allowed to continue at 30° C. for and additional 3 hours. The moisture content after drying was about 2.2%.

Similar to the phosphorus content of the treated Sample 1, only 29% of the theoretical phosphorus was incorporated into the treated Sample 2. It is believed that this was because the spray pattern of the solution was not optimized. As with the results in treating Sample 1, the RH sensitivity of the treated Sample 2 was reduced about 1.5 times for Sample 2 (See Table 2 below).

TABLE 1

Effect of STBP Addition During Fluidized Bed Drying of EA Polyester Cyan and Highlight Color Blue (HCB) Toner Particles.

| | Q/m (μC/g) | | RH Sensitivity |
|---|---|---|---|
| Experiment | C Zone | A Zone | Ratio |
| Sample 1 | −151 | −17.7 | 8.5 |
| Sample 1 + STBP | −70 | −28 | 2.5 |
| Sample 2 | −106 | −18.4 | 5.7 |
| Sample 2 + STBP | −96 | −26 | 3.7 |

The RH sensitivity ratio is based on the ratio of the charge of the toner particles in the C-zone and the A-zone. The lower the ratio, the less sensitive the particles are to RH changes. The Q/m measurement is an average number measuring the charge Q per mass m of toner particles, typically measured in microcoulombs per gram. The Q/m measurement is an average number since a distribution of charge exists on each of the toner particles.

EXAMPLE 3

This Example evaluates different placements of the nozzle spraying the additive during the fluidized bed spraying process. Spraying the solution of a surface treatment additive, in this case STBP, using a fluidized bed dryer was evaluated in a lab-scale fluidized bed dryer. During this evaluation, a significant reduction in the RH sensitivity ratio was observed despite the poor incorporation of STBP into the treated samples.

The wet cake used in the below examples was co-milled into a fine powder with a medium sized screen, for example 400 μm mesh, to improve drying. In each experiment, the loading of the wet cake in the dryer was 2.0 kilograms. The moisture content of the wet cake as loaded was approximately 35% based on measurements using a Mettler heated balance.

The settings for the fluidized bed dryer were as follows. The drying procedure began by suspending the toner particles and increasing the temperature in the dryer to 43° C. over a one hour period. Then, 4.4% STBP aqueous solution was sprayed in at 4.5 mL/min for one to two hours. Drying continued for four to five hours after the solution was added.

Following the fluidized bed drying process, but prior to submission for elemental analysis and tribocharging, the toners were dried in a vacuum oven at 35° C. for 72 hours to further reduce the moisture content to below 1%. The samples were sieved with a 250 μm vibrating sieve to remove any coarse particles that may have formed during drying. The experimental design consisted of four experiments as indicated in Table 2.

After the samples were dried, they were re-submitted for particle size measurements into aqueous solution. This was done to estimate the coarse material caused by the surface treatment/drying.

TABLE 2

Design Matrix for Toners in Fluidized Bed Dryer

| Experiment | % STBP loading $m_{STBP}/m_{dry\ toner}$ | Position of Nozzle |
|---|---|---|
| Sample 2 | 0.5 | Bottom |
| Sample 3 | 1.0 | Bottom |
| Sample 4 | 0.5 | Top |
| Sample 5 | 1.0 | Top |
| Sample 1 (control) | 0 | — |

Despite the poor STBP incorporation, time-of-flight secondary ion mass spectrometry revealed that the coverage of STBP was uniform and the fluidized bed coating procedure was comparable to the wet chemistry procedure with respect to STBP coverage and concentration.

The low incorporation of STBP was thought to be due to the less than ideal location of the spray nozzle for spraying the solution onto the toner particles. Therefore, the position of the spray nozzle and the concentration of STBP in the toner were studied. The factors tested were the incorporation of STBP onto the toner and the RH sensitivity ratio. 4% STBP solution was used and the elemental analysis of the toners is summarized below in Table 3.

TABLE 3

Elemental and Thermal Analysis of Fluidized Bed Surface Treated Toners.

| Experiment | % Moisture | $T_{g,\ on}$ (° C.) | [Na] (ppm) | [Zn] (ppm) | [P] (ppm) |
|---|---|---|---|---|---|
| Sample 2 (0.5%, bottom) | 1.34 | 56.3 | 120 | 11213 | 282 |
| Sample 3 (1.0%, bottom) | 0.85 | 54.9 | 118 | 11027 | 309 |
| Sample 4 (0.5%, top) | 1.17 | 56.1 | 164 | 12425 | 679 |
| Sample 5 (1.0%, top) | 1.53 | 54.8 | 457 | 12498 | 595 |
| Sample 1 (control) | 1.45 | 55.5 | 121 | 11077 | 283 |

The sodium, zinc and phosphorus concentrations are all part of the toner. Phosphorus is from the surface additive. Sodium and zinc are both remnants of the EA process. A zinc salt is used a coagulant, and sodium is used as counter ion on the sulfonate groups of the toner during the EA process. Spraying the STBP from the bottom of the bed had virtually no effect on incorporation of phosphorus into the toner as indicated in Table 3.

$T_g$, the glass transition temperature, is the temperature at which the polymer starts to become flexible. This is important for fusing of the toner. The fuser is a drum that melts the polymer of the toner as the paper passes beneath it. Therefore, the manner in which the toner flows is dependent upon the temperature of the fuser roll. Thus, the temperature of the fuser roll must be properly set to allow the polymer in the toner formulation to properly fuse onto the paper.

The phosphorus concentration was not signficantly improved when the sample toners were sprayed from the bottom in comparison to the control group. This suggests while spraying the additive onto the toner from the bottom provides some improvement, spraying the toners from the top provides greater STBP incorporation onto the toner particle. The larger phosphorus concentration in the toner particles sprayed from the top is reflected in the triboelectric charging measurements as shown in Table 4.

TABLE 4

Tribocharging for Fluidized Bed Surface Treated Toners

| Experiment | Q/m (μC/g) C zone | A Zone | RH ratio |
|---|---|---|---|
| Sample 2 (0.5%, bottom) | −104.8 | −27.4 | 3.8 |
| Sample 3 (1.0%, bottom) | −90.9 | −25.2 | 3.6 |
| Sample 4 (0.5%, top) | −64.9 | −27.9 | 2.3 |
| Sample 5 (1.0%, top) | −63.6 | −30.9 | 2.1 |
| Sample 1 (control) | −99.4 | −31.3 | 3.2 |

When the samples were sprayed from the top, the C-zone charge dropped while the A-zone charge was maintained. Thus, this resulted in lower RH sensitivity ratios compared to the control group. This suggests, as shown by Tables 3 and 4, that spraying the additive solution from the top more effectively incorporates STBP, or a different additive, onto the toner and improved RH sensitivity ratio relative to a control particle, than spraying the additive solution from the bottom.

Further, these Examples clearly show that an additive can be applied to the surface of a toner particle to improve the toner's RH sensitivity. More particularly, this additive can be applied to the toner particle during the drying process, instead of performing a completely separate process to apply the additive to the toner, and then performing a separate drying process.

While this invention has been described in conjunction with specific embodiments described above, it is evident that many alternatives, modification and variations will be apparent to those skilled in the art. Accordingly, the preferred embodiments of the invention, as set forth above, are intended to be illustrative and not limiting. Various changes may be made without departing from the spirit and scope of the invention.

What is claimed is:

1. A method of manufacturing a toner particle comprising:

forming polyester toner particles by emulsion/aggregation;

fluidizing the toner particles with a stream of inert gas while spraying the toner particles with a solution containing an additive affecting relative humidity sensitivity; and wherein the additive contacts a surface of the toner particles and the additive remains on the surface of the toner particles.

2. The method according to claim 1, wherein the spraying of the toner particles occurs from above the toner particles.

3. The method according to claim 1, wherein the fluidizing is effected in a fluidized bed sprayer or equivalent equipment.

4. The method according to claim 1, wherein the fluidized bed sprayer has more than one nozzle.

5. The method according to claim 4, wherein the stream of inert gas is introduced into the sprayer via one nozzle.

6. The method according to claim 4, wherein the additive is introduced into the sprayer via a separate nozzle.

7. The method according to claim 6, wherein the separate nozzle is arranged in such a manner that the additive is sprayed onto the polyester toner particles from above.

8. The method according to claim 1, wherein the inert gas is air.

9. The method according to claim 1, wherein the additive provides a hydrophobic layer upon the toner particles.

10. The method according to claim 1, wherein the additive is a colloidal fluoropolymer.

11. The method according to claim 1, wherein the additive is an ammonium salt or a phosphonium salt.

12. The method according to claim 11, wherein the phosphonium salt is stearyltributylphosphonium bromide.

13. The method according to claim 1, wherein the toner includes a colorant.

14. The method according to claim 13, wherein the colorant is a pigment of cyan, yellow, magenta, white, black or any combination thereof.

15. The method according to claim 1, wherein the solution comprises an aqueous solution and contains the additive in an amount of about 1% to about 10% by weight of the solution.

16. The method according to claim 1, wherein the additive is sprayed onto the toner particle at a constant rate.

17. The method according to claim 1, wherein a rate at which the additive is sprayed onto the toner particle is about 0.25 to about 2.3 mL/min/kg wet cake.

18. The method according to claim 3, wherein a temperature within the fluidized bed sprayer is maintained between about 30° C. to about 45° C.

19. The method according claim 1, wherein after the spraying is completed, the fluidizing continues for about 1 to 5 hours.

20. The method according to claim 1, wherein fluidizing occurs after the toner particles have been washed.

* * * * *